US007217090B1

(12) United States Patent
Del Rio

(10) Patent No.: US 7,217,090 B1
(45) Date of Patent: May 15, 2007

(54) SEALS

(75) Inventor: Eddy H. Del Rio, Royal Palm Beach, FL (US)

(73) Assignee: The Anspach Effort, Inc, Palm Beach Gardens, FL (US)

( * ) Notice: Subject to any disclaimer, the term of this patent is extended or adjusted under 35 U.S.C. 154(b) by 143 days.

(21) Appl. No.: 11/093,156

(22) Filed: Mar. 29, 2005

Related U.S. Application Data

(60) Provisional application No. 60/567,188, filed on Apr. 30, 2004, provisional application No. 60/567,189, filed on Apr. 30, 2004.

(51) Int. Cl.
*F04D 29/12* (2006.01)

(52) U.S. Cl. ..... 415/230

(58) Field of Classification Search ..... 415/229, 415/230; 277/407, 511, 529, 540, 616, 626, 277/627, 644
See application file for complete search history.

(56) References Cited

U.S. PATENT DOCUMENTS 2,990,220 A * 6/1961 Malone ..... 384/484
3,156,158 A * 11/1964 Pamplin ..... 418/217
3,890,021 A * 6/1975 Smith et al. ..... 384/409
4,042,248 A * 8/1977 Williamitis ..... 277/555

* cited by examiner

*Primary Examiner*—Ninh H. Nguyen
(74) *Attorney, Agent, or Firm*—Norman Friedland

(57) ABSTRACT

A seal for a rotating machine is designed to be operable when set and cured in situ and one seal arrangement includes a washer having a beveled face and a nut having a beveled face axially spaced therefrom and mounted in a housing, the one seal arrangement is mounted between the bevel faces and assembled to be angularly disposed relative to the rotating shaft. The bottom edge defines a lip that defines a minuscule opening allowing only the air from an air/oil mist to leak downstream thereof. Another seal arrangement also set and cured in situ, is mounted adjacent the rotating inner race of a ball bearing so that the reaction from the seals static relationship and the rotating inner race causes the oil of the oil mist to be slung in a direction complementing the centrifugal force while the air flows axially. When the two seals are mounted in tandem the oil does not leak pass the angularly disposed seal.

16 Claims, 2 Drawing Sheets

SEALS

This application claims the benefits under 35 U.S.C. § 119(e) of the U.S. provisional patent application 60/567,188 filed and 60/567,189 on Apr. 30, 2004

RELATED APPLICATIONS

This invention relates to the pneumatic motor entitled SURGICAL PNEUMATIC MOTOR and was invented by myself and co-inventor Douglas Perry and identified as Provisional Application No. 60/567,188 recently filed as a non-provisional application and is incorporated herein by reference and is commonly assigned to The Anspach Effort, Inc.

FEDERALLY SPONSORED RESEARCH OR DEVELOPMENT

Not applicable

TECHNICAL FIELD

This invention relates to seals and particularly to seals that are made operative in situ and to seals that serve to separate the air/oil mist used in lubrication of high speed rotary machines and to both of these seals that operate in conjunction with each other to prevent lubricant leakage.

BACKGROUND OF THE INVENTION

As is well known by those skilled in the sealing technology leakage of the oil intended to lubricate the components of a motor in a high speed rotating machine is and continues to be a serious concern not only because of the inefficient use of the lubricant but because the escaped lubricant can be a hazard to the environment as well as being a serious problem in the operation of the rotary machine in application where the high speed machine is being utilized. The latter is a real concern in the medical environment where it is abundantly important to prevent contamination of the patient and the operating equipment that is used in surgery.

This invention has solved this problem by the use of two inventive seals that independently are unique and when placed in tandem in a lubricated ball bearing environment have proven to be 100% leak proof. According to this invention, the seals are a disk shaped made from a thermal setting material such as Teflon® and are fixedly mounted around the rotating shaft such that they are static, and one of the seals is disk shaped and mounted adjacent to a judiciously spaced seal retainer that serves to angle that seal relative to the shaft for defining a lip. The other seal is also disk shaped, and is judiciously mounted relative to the inner race of the ball bearing in the rotating machine so that the oil of an air/oil mist is slung toward the direction of the centrifugal force and the air is allowed to flow in a direction opposite to the direction of the centrifugal force so that the delta pressure across the seal will dictate the leakage of air. Both seals are made operative in situ by rotating the machine to generate sufficient heat to deform the seals and cause them to set so that it virtually allows only the air to escape while trapping the oil. These seals when mounted in tandem serve to maintain a leak proof sealing device.

An example where this invention is efficacious is where a vane motor in a pneumatic surgical motor powers a surgical drill or other medical instruments and the vane motor is supported by ball bearings. This invention locates the tandem seals downstream of the ball bearings where one of the seals is adjacent to the inner race of the ball bearing and the other is spaced axially downstream thereof. An oil/mist is utilized to flow into the vane motor to lubricate the vanes and the seals prevent the oil to leak in the mechanism that supports the drill or other surgical instruments to assure that these parts as well as the patient and the ambient do not become contaminated by leakage oil.

SUMMARY OF THE INVENTION

The foregoing and other features of the present invention will become more apparent from the following description and accompanying drawings.

An object of this invention is to provide a seal system that improves the sealing characteristics of an instrument that operates at a high rotational speed.

A further object of this invention is to provide in a high speed rotating machine a seal set and cured in situ is mounted adjacent to the inner race of a ball bearing used in the machine such that the oil in an oil/air mist lubrication system is slung upwardly in the direction of the centrifugal force and the air is directed along the rotating shaft and outwardly of the seal and the air is directed to flow along the shaft of the rotating machine.

Another object of this invention is to provide a seal made from a thermal setting material that is rendered operative in situ. One of the seals is contoured in the shape of a disk and is mounted to be angularly disposed relative to the adjacent rotating shaft by subjecting the seal to the high speed operation of the machine so that the heat generated by the friction deforms the seal in the operative mode.

Another object of this invention is to provide a seal system for a high speed rotational machine powered by a vane motor that is lubricated by an oil/mist including the first seal described in the above paragraph and the second seal described in the above paragraph mounted in tandem such that the first seal directs the oil of the oil mist in the direction of the centrifugal force and the air is passed to the second seal where the air is allowed to leak as a function of the $\Delta$ pressure across the seal.

A feature of this invention is to provide seals as described above made from a Teflon® material and set and cured in situ.

DETAILED DESCRIPTION OF THE INVENTION

While this invention is being described in its preferred embodiment as seals that are utilized in a surgical pneumatic drill powered by a vane motor 11 utilizing the two tandem mounted unique seals of this invention, as one skilled in the art will appreciate one of the seals of the two seals can equally be employed in a surgical drill and one or both seals can be employed in other rotary machines used in the medical field or in rotary machines used for other applications.

Figure 1:
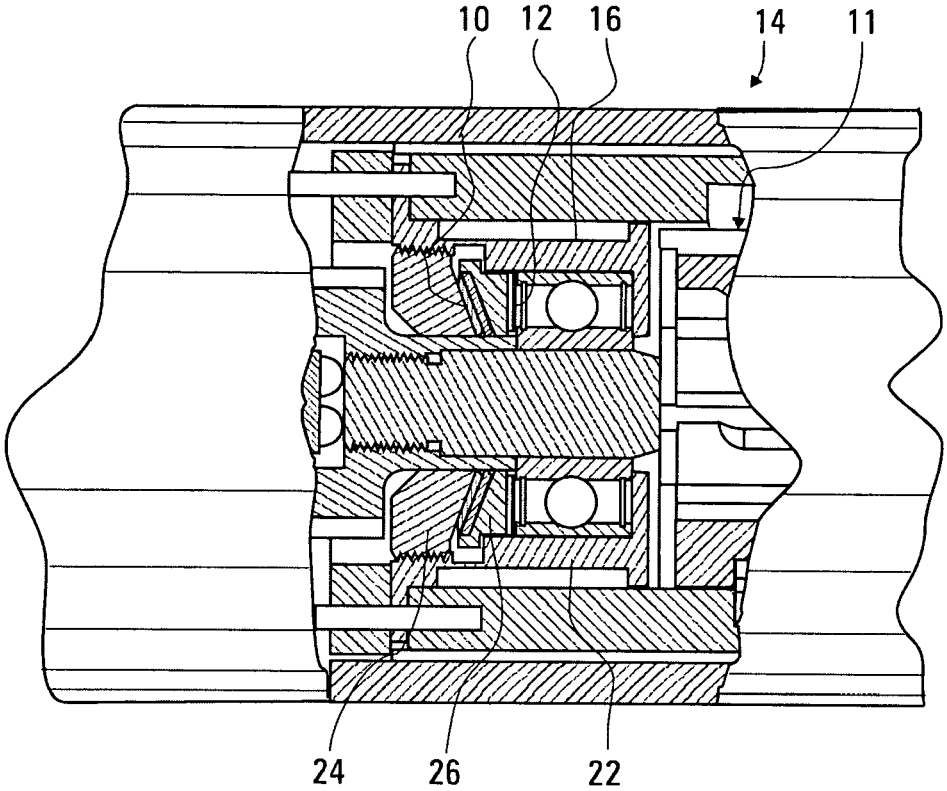
FIG. 1 is a partial view partly in full and partly in section of a pneumatic drill powered by a vane motor illustrating the seals of this invention.
Figure 2:
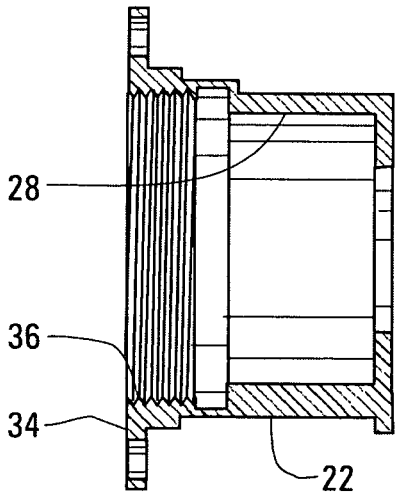
FIG. 2 is a sectional view illustrating the seal/bearing housing of this invention.
Figure 6:
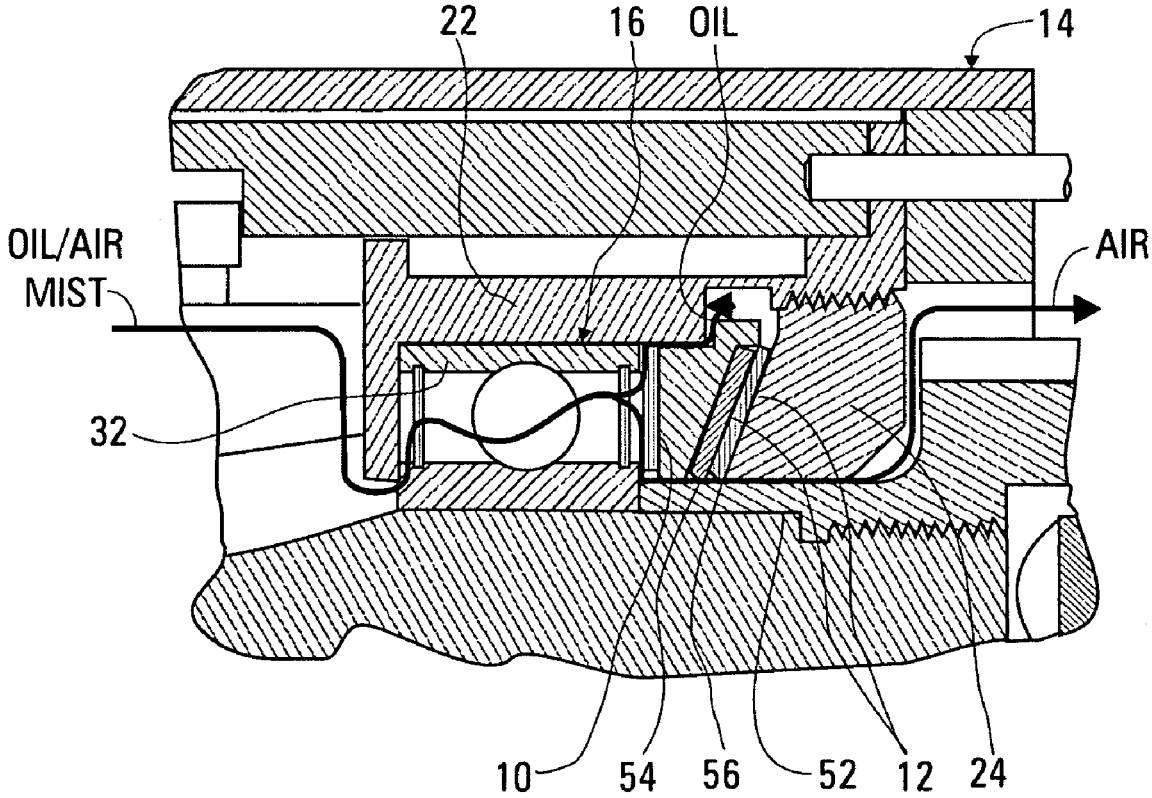
FIG. 6 is a view in section and schematic illustrating an example of the seals of this invention mounted in tandem used in a surgical drill powered by a vane motor.

Referring to all of the Figs. and as best seen in FIGS. 1 and 6, the inventive seals generally illustrated by reference numerals 10 and 12 are mounted in tandem in a rotary machine generally illustrated by reference numeral 14 which in this instance is a surgical pneumatic drill powered by vane motor 11. For the sake of convenience and simplicity the details of the surgical pneumatic motor are eliminated hear from and reference can be made to the description in the Provisional patent No. 60/567,188 filed on Apr. 30, 2004 and U.S. Pat. No. 6,329,778 granted to Culp et al on Dec. 11, 2001. Suffice it to say that a typical surgical pneumatic motor includes a vane motor for driving an output shaft and chuck means for attaching the drill bits or other surgical instruments thereto. The seals, obviously, serve to prevent oil from escaping from the motor into the ambient. It goes without saying that some seals and/or seal systems are more effective than others. This invention has proven to be leak free so that no oil escapes into the environment.

Figure 5:
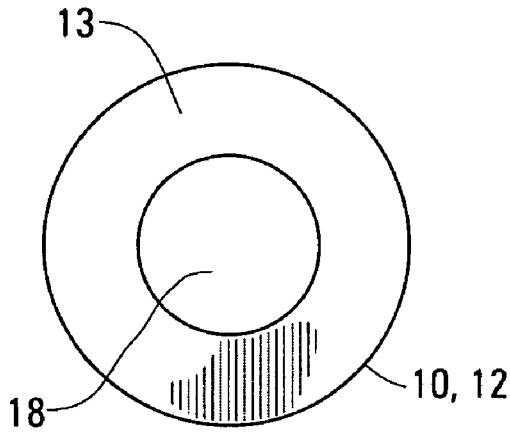
FIG. 5 is a plan view illustrating the seals of this invention.
Figure 5A:
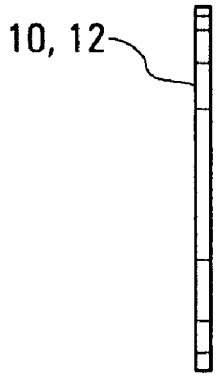
FIG. 5A is a side view of the seal depicted in FIG. 5.

The seals 10 and 12 are shown mounted in tandem downstream from the ball bearing 16 and are preferably made from a synthetic material such as Teflon® which is a thermosetting material. First consider the seal 10 which are preferably two identical disc seals illustrated in FIGS. 5 and 5A which is a plan view and a side view. As noted the seals 10 and 12 are configured in the shape of a washer and include a circular shaped main body 13 and the central opening 18 that fits over the shaft 20 (FIG. 1).

Figure 3:
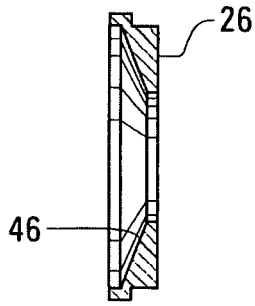
FIG. 3 is a sectional view illustrating the seal support washer of this invention.
Figure 4:
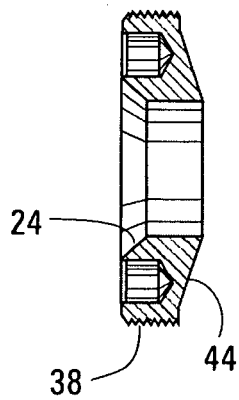
FIG. 4 is a view in section of the seal retaining nut of this invention.

Considering the seal 12 which is fitted into the seal/bearing housing 22 shown in FIGS. 1, 3 and 6 and when assembled is press fitted therein. Seal 12 in this instance is made from two identical main bodies 13 and are disposed into the seal/bearing housing 22 between the seal retaining nut 24 and seal support washer 26 as will described immediately below. The seal 12 is press fitted against the inner and outer races 30 and 32, respectively of ball bearing 16 as will be described in further detail herein below.

Referring again to seal 12, during assembly, the seal support washer 26 is first inserted into the seal/bearing housing 22 with the beveled face 46 located to receive the seal 10. The two main bodies 13 of the seal 12 are inserted into the seal/bearing housing 22 in the shape depicted in FIGS. 5 and 5A. Then the seal retaining nut 24 is threadably fitted into the end 34 of the seal/bearing housing 22 via the internal threads 36 of the seal/bearing housing 22 and the external threads 38 formed on the outer periphery 40 to the seal retaining nut 24. Seal 12 is wedged between the beveled face 44 of the seal retaining nut 24 and the beveled face 46 of the seal support washer 26. This action forces the seal 12 to assume the angled position relative to the shaft 52. The bearing, seal support housing 22 define a rigid solid connection between the seal retaining nut 24 and the vane motor 11, only partially shown.

It is apparent from the foregoing, that when the fixed double seal 12 is assembled and the seal retaining nut is torqued down the seals 12 will be disposed angularly relative to the center line of the shaft 52 and the bottom 54 of the pair of seals 12 will be inclined relative to shaft 52 with the edges thereof define lips 56 bearing against the shaft 52. After assembly, the machine is operated with the seals in situ so that the shaft 52 rotates at sufficient rpm to cause the seals 12 to heat and become set to define a minuscule opening between the edge 56 of the seal 12 and the rotating shaft 52. This opening is sufficient to allow the air to escape and prevent the oil from leaking.

Seal 10 is identical in material and size to the main body 13 of the seal 12 and is wedged between the outer face 60 of the seal support washer 26 and the outer surfaces of the inner race 30 and outer race 32 of bearing 16. According to this invention the seal 10 is urged against the inner race 30 and is spaced from the outer race 32 and the inner end of seal 10 is spaced from the shaft 52. As noted the seals 10 and 12 are in fixed relationship to the rotating shaft 52 and the inner race 30 rotates with shaft 52. This seal 10 is also set and cured in situ as was described in connection with seal 12. As best seen in FIG. 6 the rotary machine 14 is lubricated by flowing an air/oil mist into the machine as shown and toward the bearing 16. The whirling action of the inner race 30 with respect to seal 10 causes the oil of the oil/mist to be slung and flow in the direction of the centrifugal force as shown by the arrow labeled oil and the air flows through the minuscule opening defined by the edges 56 of seal 12 and the surface of the shaft 52.

What has been shown by this invention are two seals that are individually unique and define face seals that when employed as a sealing system for a rotary machine that is lubricated by an oil/air mist, the seals serve to reduce heat generation and provide a sling action to the oil. The seals are deformed and cured in situ and the seal adjacent the bearing bears against the inner race thereof and when operative serves to prevent oil from escaping into the ambient and into the component parts downstream of the seals.

Although this invention has been shown and described with respect to detailed embodiments thereof, it will be appreciated and understood by those skilled in the art that various changes in form and detail thereof may be made without departing from the spirit and scope of the disclosed invention.

The invention claimed is:

1. For a rotating machine having a rotary shaft being lubricated by an oil/air mist, a seal being made from a thermal setting material and being configured in the shape of a washer having a central opening with an inner edge and said shaft passing through said central opening and, a first fixed member having a beveled face surrounding said shaft, a second fixed member having a beveled face surrounding said shaft and being axially spaced from said first fixed member, said seal when assembled between the bevel face of said first member and the bevel face of said second member is positioned angularly relative to said rotating shaft and for defining a lip at said inner edge of said seal and said lip being is in close proximity to said rotating shaft, said seal being set and cured in situ by operating said rotating machine at a predetermined rotational speed whereby only the air of said oil/air mist will escape downstream of said seal.

2. For a rotating machine as claimed in claim 1 wherein said material is taken from a group consisting essentially of a thermal setting synthetic material, Teflon®, Teflon® virgin.

3. For a rotating machine as claimed in claim 2 including a housing having a central bore surrounding said shaft and including a wider diameter portion at one end, said first member mounted in said bore, said second member mounted in said bore, said housing having inner threads formed adjacent to said wider portion as said end and said second member having external threads threadably engaging said inner threads for forcing said seal to bear against said bevel edge of said first member and the bevel edge of said second member.

4. A rotating machine as claimed in claim 3 wherein said seal has a main body, at least a second main body mounted in juxtaposition to said main body.

5. For a rotating machine having a bearing supporting a rotary shaft and being lubricated by an oil/air mist, a bearing/seal housing having a central bore and larger diameter portion surrounding said rotating shaft, a seal configured in the shape of a washer having a central opening mounted in said larger diameter portion of said bearing/seal housing and surrounding said shaft and being made from a thermal setting material, a seal supporting washer having a beveled face mounted in said larger diameter portion of said bearing/seal housing also having a central bore surrounding said rotating shaft, a seal nut having a beveled face mounted in said larger diameter portion of said bearing/seal housing and having central bore surrounding said shaft, said seal when assembled between the bevel face of said seal nut and the bevel face of said seal supporting washer is angularly disposed relative to said rotating shaft and defines a lip at the bottom edge of said seal that is in close proximity to said rotating shaft, said seal being set and cured in situ by operating said rotating shaft at a predetermined revolutions per minute wherein said lip defines a minuscule space between said lip and said shaft whereby only the air of said oil/air mist will escape downstream of said seal.

6. For a rotating machine as claimed in claim 5 wherein said seal is made from a Teflon® material.

7. For a rotating machine as claimed in claim 6 wherein said bearing/seal housing includes inner threads formed on said larger diameter portion adjacent the end thereof, and said seal nut includes outer threads formed on the outer diameter thereof wherein said seal nut forces said seal to the angular position by torquing down said seal nut.

8. A seal for a rotating machine having a rotary shaft, a ball bearing having an inner race and an outer race supporting said rotary shaft and being lubricated by an air/oil mist, said seal formed in the shape of a washer and having a central bore receiving said rotary shaft and an inner edge spaced from said rotary shaft, said seal being supported in fixed relation to said inner race and outer race, and mounted adjacent thereto, said seal being made from a thermal setting material and being set and cured in situ by running said rotary shaft at high speed to generate heat so that the heat deforms said material and stopping the rotation of said shaft and allowing said material to set, said inner race rotating with said shaft so that the reaction between the space between said seal and said inner race causes the oil to be slung in a direction toward the centrifugal force of said rotating bearing and shaft and allowing the air to flow between said inner edge and said rotary shaft.

9. A seal for a rotating machine as claimed in claim 8 including a vane motor mounted upstream of said bearing and said air/oil mist flowing through said vane motor.

10. In combination, a rotating machine including a vane motor, a rotary shaft and a ball bearing having an inner race and outer race supporting said rotary shaft and said rotary shaft being powered by said vane motor, said vane motor and said ball bearing being lubricated by an oil/air mist, a first seal being made from a thermal setting material and being configured in the shape of a washer having a central opening with an inner edge and said shaft passing through said central opening and, a first fixed member having a beveled face surrounding said shaft, a second fixed member having a beveled face surrounding said shaft and being axially spaced from said first fixed member, said first seal when assembled between the bevel face of said first member and the bevel face of said second member is positioned angularly relative to said rotating shaft and for defining a lip at said inner edge of said first seal and said lip being is in close proximity to said rotating shaft, a second seal formed in the shape of a washer and having a central bore receiving said rotary shaft and having an inner edge spaced from said rotary shaft, said seal being supported in fixed relation to said inner race and outer race, and mounted adjacent thereto, said inner race rotating with said shaft so that the reaction between the space between said seal and said inner race causes the oil to be slung in a direction toward the centrifugal force of said rotating bearing and shaft and allowing the air to flow between said inner edge and said rotary shaft, said first seal and said second seal being made from a thermal setting material and being set and cured in situ by operating said rotating machine at a predetermined rotational speed whereby only the air of said oil/air mist will escape downstream of said first seal.

11. For a rotating machine as claimed in claim 10 wherein said material is taken from a group consisting essentially of a thermal setting synthetic material, Teflon®, Teflon® virgin.

12. For a rotating machine as claimed in claim 11 including a housing having a central bore surrounding said shaft and including a wider diameter portion at one end, said first member mounted in said bore, said second member mounted in said bore, said housing having inner threads formed adjacent to said wider portion as said end and said second member having external threads threadably engaging said inner threads for forcing said seal to bear against said bevel edge of said first member and the bevel edge of said second member.

13. A rotating machine as claimed in claim 12 wherein said seal has a main body, at least a second main body mounted in juxtaposition to said main body.

14. In combination, a rotating machine having a ball bearing with an inner race and an outer race supporting a rotary shaft, said rotary machine having a vane motor powering said rotary shaft and said vane motor and said bearing being lubricated by an oil/air mist, a bearing/seal housing disposed adjacent to said bearing having a central bore and larger diameter portion surrounding said rotating shaft, a first seal configured in the shape of a washer having a central opening mounted in said larger diameter portion of said bearing/seal housing and surrounding said shaft and being made from a thermal setting material, a seal supporting washer having a beveled face mounted in said larger diameter portion of said bearing/seal housing also having a central bore surrounding said rotating shaft, a seal nut having a beveled face mounted in said larger diameter portion of said bearing/seal housing and having central bore surrounding said shaft, said first seal when assembled between the bevel face of said seal nut and the bevel face of said seal supporting washer is angularly disposed relative to said rotating shaft and defines a lip at the bottom edge of said seal that is in close proximity to said rotating shaft, a second seal formed in the shape of a washer and having a central bore receiving said rotary shaft and having an inner edge spaced from said rotary shaft, said second seal being supported in fixed relation to said inner race and outer race, and mounted adjacent thereto, said inner race rotating with said shaft and said second seal being static so that the reaction between said second seal and said inner race causes the oil to be slung in a direction toward the centrifugal force of said rotating bearing and shaft and allowing the air to flow between said inner edge and said rotary shaft, said first seal and said second seal being made from a thermal setting material and being set and cured in situ by operating said rotating machine at a predetermined rotational speed whereby only the air of said oil/air mist will escape downstream of said first seal.

15. For a rotating machine as claimed in claim 14 wherein said first seal and said second seal are made from a Teflon® material.

16. For a rotating machine as claimed in claim 15 wherein said bearing/seal housing includes inner threads formed on said larger diameter portion adjacent the end thereof, and said seal nut includes outer threads formed on the outer diameter thereof wherein said seal nut forces said first seal to the angular position by torquing down said seal nut.

* * * * *